United States Patent [19]

Sato et al.

[11] Patent Number: 4,978,238

[45] Date of Patent: Dec. 18, 1990

[54] PRINTING HEAD

[75] Inventors: Hiroshi Sato; Yoshiaki Miyauchi, both of Tokyo, Japan

[73] Assignee: Seikosha Co., Ltd., Tokyo, Japan

[21] Appl. No.: 447,291

[22] Filed: Dec. 7, 1989

[30] Foreign Application Priority Data

Dec. 8, 1988 [JP] Japan ..... 63-310917

[51] Int. Cl.[5] ..... B41J 2/23

[52] U.S. Cl. ..... 400/124; 101/93.05

[58] Field of Search ..... 400/124, 157.2; 101/93.05

[56] References Cited

U.S. PATENT DOCUMENTS 4,225,250 9/1980 Wagner et al. ..... 400/124
4,433,926 2/1984 Isobe et al. ..... 400/124
4,591,280 5/1986 Bringhurst ..... 400/124
4,674,896 6/1987 Yasunaga et al. ..... 400/124
4,728,205 3/1988 Hasumi et al. ..... 400/124

*Primary Examiner*—Edgar S. Burr
*Assistant Examiner*—C. A. Bennett
*Attorney, Agent, or Firm*—Jordan and Hamburg

[57] ABSTRACT

A printing head has an annular resilient plate on which to centripetally dispose driving arms, an electromagnetic driving device for driving printing wires by releasing deviated driving arms while exciting a demagnetizing coil, an annular stopper plate and an annular thin tabular stopper interposed between the stopper plate and the driving arms. Based on this construction flexures of the driving arms toward a platen can be prevented, thereby eliminating double printing or print skipping.

13 Claims, 8 Drawing Sheets

FIG. 11 A
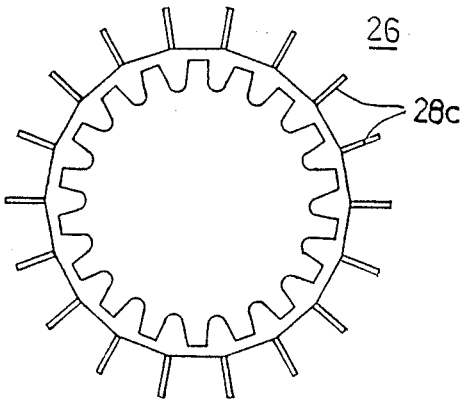
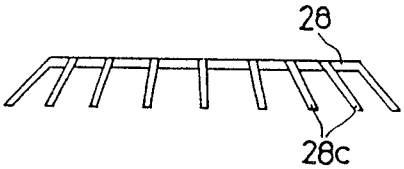
FIG. 11B
FIG.12
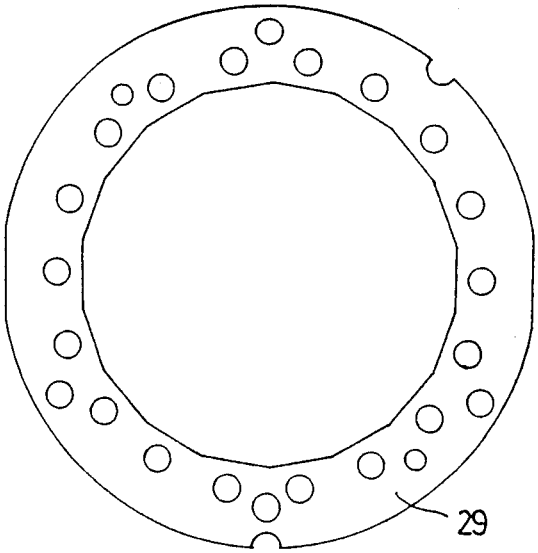

PRINTING HEAD

BACKGROUND OF THE INVENTION

1. Field of the Invention

The present invention relates to a printing head of the spring release type.

2. Description of the Prior Art

A typical arrangement of a well-known spring release type printing head includes driving arms for driving printing elements formed on a resilient plate, the driving arms being biased by the magnetic flux of a permanent magnet by means of an electromagnetic driving device provided with the permanent magnet and a demagnetizing coil, the biased driving arms being released by offsetting the magnetic flux of the permanent magnet as the coil is excited, thus driving the printing elements via the driving arms. In a spring release type printing head, prevention of flexures of the driving arms towards a platen immediately after the printing elements have impinged on the platen involves the use of a stopper provided for the resilient plate (e.g., Japanese Patent Laid-Open Publication No. 54-13147), or an auxiliary resilient plate disposed in parallel (e.g., Japanese Utility Model Publication No. 62-24530).

It cannot, however, be said that the prior art structures described above are capable of completely eliminating flexures of the driving arms towards the platen. More specifically, in a spring release type printing head, when the printing element collides with the platen after releasing the armature of the driving arm, the armature further moves toward the platen with inertia, while the driving arm undergoes reaction because of the platen, resulting in an S-shaped flexure. For this reason, the impact-time of the printing element increases, thereby not only hindering speed-up of the printing process but also causing vibrations for a short period of time until the resilient plate subjected to the S-shaped flexure reverts to a normal state. The vibrations in turn hinder peculiar motions of the armature, and it follows that double printing and print skipping take place. Besides, stress on the armature system increases in magnitude, which in turn exerts adverse influences on the durability.

The prior art arrangements described above entail a complicated configuration of a highly rigid material to construct a stopper, and for this reason defects result which require additional time for processing and involving costly production.

SUMMARY OF THE INVENTION

It is an object of the present invention, which is provided to overcome the foregoing disadvantages inherent in the prior art, to provide an easy-to-manufacture and inexpensive printing head which exhibits a high durability and is capable of attaining high-speed printing without causing double printing and print skipping with a reduction in returning time by preventing flexures of the driving arms.

To achieve this object, according to one aspect of the present invention, there is provided a printing head which comprises a ring-like resilient plate on which a plurality of driving arms are centripetally disposed; an electromagnetic driving means, provided with a permanent magnet and a coil, for driving printing elements via the driving arms by effecting the steps of moving the driving arms by utilizing the magnetic flux of the permanent magnet to hold the driving arms and then releasing the driving arms by offsetting the magnetic flux of the permanent magnet by exciting the coil; a ring-like stopper plate provided on the advancing side of the driving arms; and a ring-like stopper composed of a thin tabular member interposed between the stopper plate means and the driving means.

Based on this construction, a ring-like spacer formed of a thin tabular member is interposed between the resilient plate and the stopper plate. In one embodiment, the stopper is disposed between the stopper plate and the spacer at a position where the stopper overlies the driving arms.

The stopper plate is perforated with a plurality of engaging holes while the stopper is formed with a plurality of protrudent engaging parts engaging the engaging holes.

In another embodiment, there is disposed between a base portion of the resilient plate and the stopper plate a ring-like thin tabular spacer, the stopper being disposed radially inwardly to face the driving arms. The stopper has a larger plate thickness than the spacer. In this embodiment the stopper is provided with a plurality of leg portions radially extending into spaces between the driving arms.

The stopper interposed between the stopper plate and the driving arms functions to hinder, when the driving arms are released, the forward movements of the driving arms faster by a time value equivalent to the thickness of the stopper. As a result, the forward movement due to inertia after forming dots by the printing elements is prevented, and extra flexures of the driving arms can be prevented. During assembly, it is sufficient to place the laminated stopper between the stopper plate and the driving arms.

BRIEF DESCRIPTION OF THE DRAWINGS

Other objects and advantages of the present invention will become apparent during the following discussion taken in conjunction with the accompanying drawings, in which:

FIGS. 1 to 6 in combination show one embodiment of the present invention. FIGS. 7 to 12 in combination show another embodiment thereof.

FIG. 1 is an enlarged sectional view of a principal portion of the printing head;

FIG. 2 is a partially cut-away plan view of the principal portion thereof;

FIG. 3 is a partially cut-away plan view of a resilient plate;

FIG. 4 is a plan view of a stopper plate;

FIG. 6 is a plan view of a spacer;

FIG. 7 is an enlarged sectional view of a principal portion of the printing head;

FIG. 8 is a partially cut-away plan view of the principal portion thereof;

FIG. 9 is a partially cut-away plan view of a resilient plate;

FIG. 10 is a plan view illustrating a stopper plate;

FIG. 11(A) is a plan view of a stopper;

FIG. 11(B) is a front elevation thereof; and

FIG. 12 is a plan view of a spacer.

Description of the Preferred Embodiments

Figure 1:
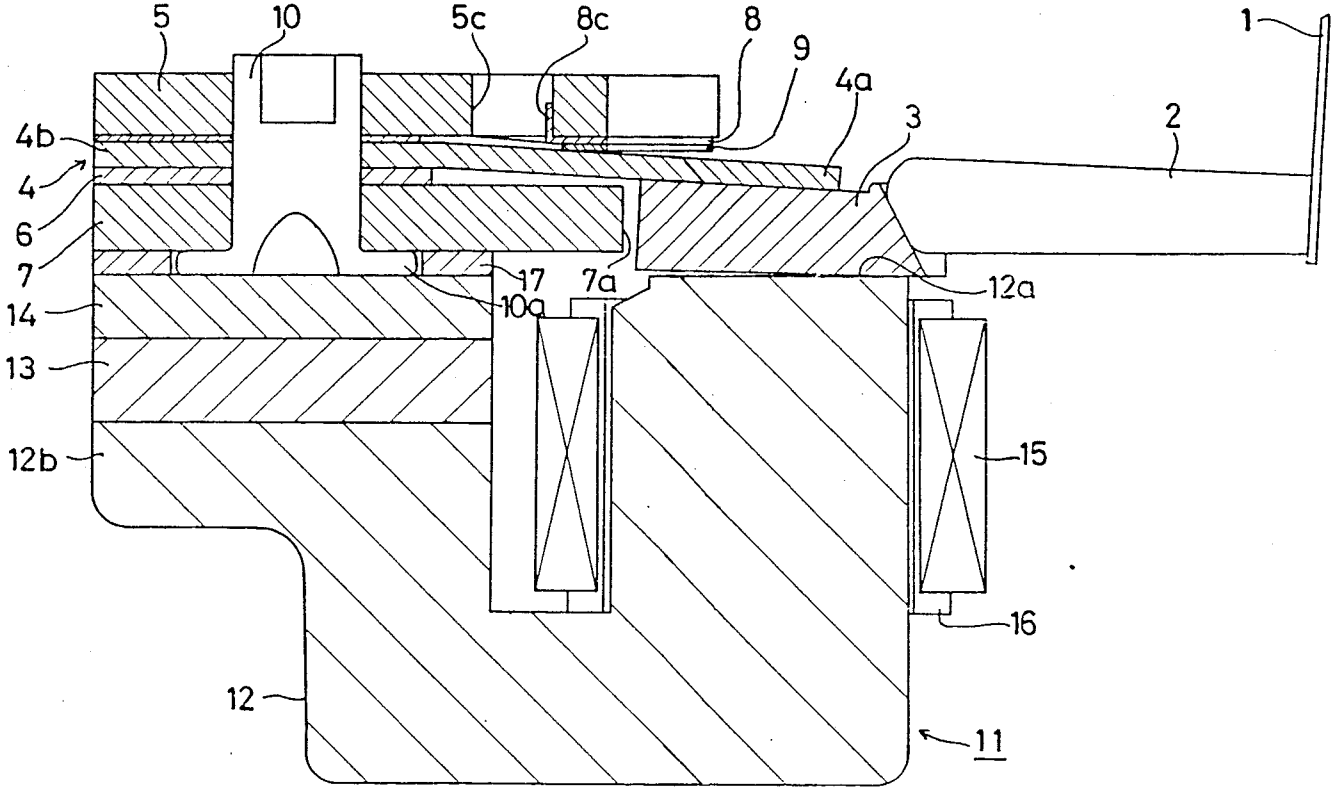
Figure 2:
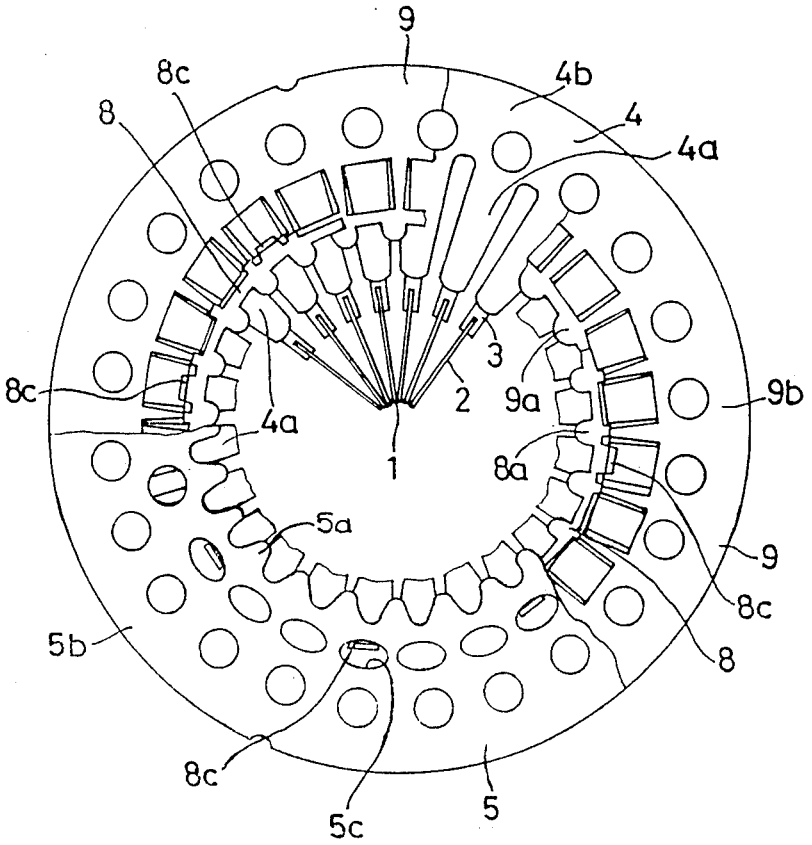
Figure 3:
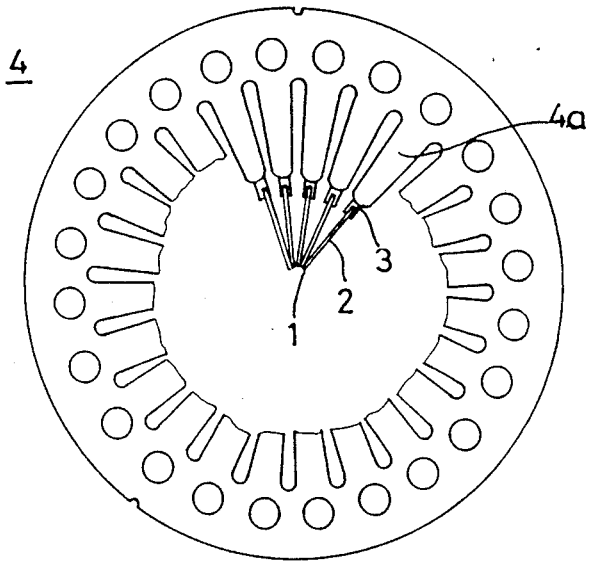

FIGS. 1 through 6 in combination show one embodiment of the present invention. A plurality of printing wires 1 serving as printing elements are, as shown in FIGS. 1 and 2, so guided by an unillustrated wire guide as to be movable back and forth. Rear ends of the printing wires 1 are fixed to one end of each of driving levers 2, while the other ends thereof are linked to armatures (movable yokes) 3. The armatures 3 are, as illustrated in FIGS. 2 and 3, fixed by spot welding to a plurality of driving arms 4*a* extending centripetally from a ring-like resilient plate 4.

The resilient plate 4 is sandwiched in between a stopper plate 5 provided on the advancing side of the driving arms 4*a* after being released and a spacer ring 6 and a yoke plate 7 provided on the retreating side thereof. A screw 10 penetrating the yoke plate 7, the spacer ring 6 and the driving arms 4*a* are screwed into the stopper plate 5, thus fixing these components together. The stopper plate 5, the resilient plate 4 and the spacer ring 6 are formed of non-magnetic materials, whereas the yoke plate 7 and the screw 10 are formed of magnetic materials. The yoke plate 7 is perforated with holes 7*a* penetrable by the armatures 3, corresponding to the configuration of placement of the driving arms 4*a*. A rear end of the screw 10 is formed with a head portion 10*a* contiguous to a rear end surface of the yoke plate 7.

Figure 4:
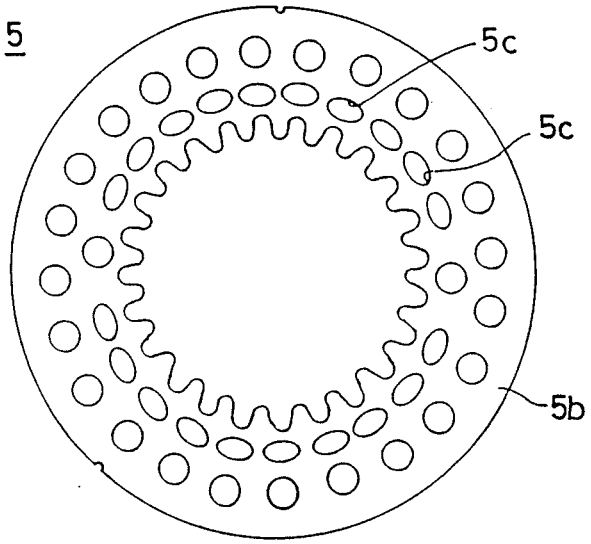

The stopper plate 5 is, as shown in FIG. 4, formed with an outer peripheral portion 5*b* having a diameter corresponding to a base portion 4*b* of the resilient plate 4 and with an inner peripheral portion having a diameter corresponding to the driving arms 4*a*. The stopper plate 5 is formed with a plurality of projections 5*a* protruding inwards and each standing astride two driving arms 4*a* adjacent to each other. A plurality of engaging holes 5*c* are perforated along the projections 5*a*.

Figure 5A:
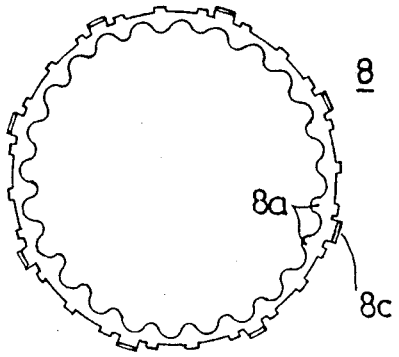
FIG. 5(A) is a plan view of a stopper.
Figure 5B:
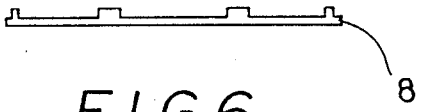
FIG. 5(B) is a front elevation thereof.

As shown in FIG. 1, a stopper 8 composed of a thin tabular member is interposed between the stopper plate 5 and the driving arms 4*a*. A spacer 9 is disposed between the resilient plate 4 and the stopper plate 5, and more specifically between the stopper 8 and the driving arms 4*a*. Because of this construction, there is a gap between the stopper plate 5 and the driving arm 4*a* which is larger by the thickness of the spacer 9 than a gap between the stopper plate 5 and the base portion 4*b* of the resilient plate 4. The stopper 8, as shown in FIG. 5, has a ring-like configuration having a diameter corresponding to the driving arms 4*a*. An outer periphery of the stopper 8 is provided with a plurality of engaging pieces 8*c* each protrusively bent to engage with engaging holes 5*c* in the stopper plate 5, thereby preventing relative rotation and retaining the stopper 8 in position. The inner periphery of the stopper 8 is formed with a plurality of projections 8*a* each protruding inwards to stand astride two driving arms adjacent to each other.

Figure 6:
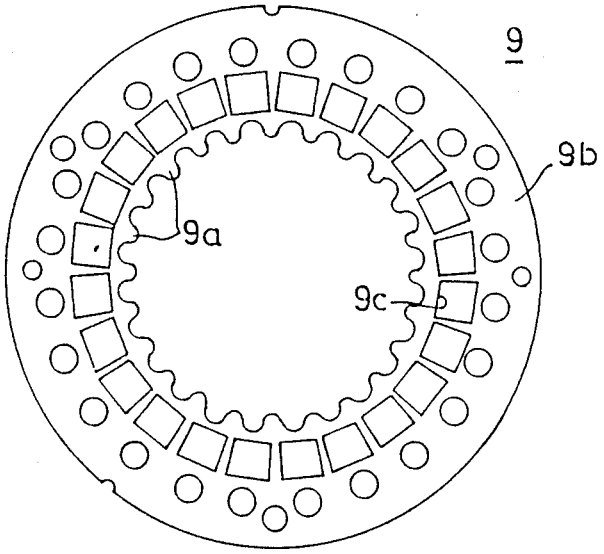

The spacer 9 includes, as shown in FIG. 6, an outer peripheral portion 9*b* having a diameter corresponding to the base portion 4*b* of the resilient plate 4. Formed along the inner periphery of the spacer 9 are projections 9*a* which overlap with the projections 8*a* of the stopper 8. The spacer 9 also includes holes 9*c* formed in positions aligned with the engaging holes 5*c* of the stopper plate 5, thus providing passages communicating with the outside via gaps between the driving arms 4*a*. This further facilitates the operation of taking out, e.g., contaminants therein during assembly.

An electromagnetic driving device 11 is, as shown in FIG. 1, located behind the driving arm assembly. Specifically, a U-shaped core piece 12 is so disposed that one end surface 12*a* thereof faces the armatures 3. On the other end surface 12*b* of the core piece 12, an integral connection is provided which faces the base portion 4*b* of the resilient plate 4. A permanent magnet 13 and a magnet plate 14 are sandwiched in between the other end surface 12*b* of the core piece and the screw head portion 10*a*. A coil 15 is wound on a part of the core piece 12 through a coil bobbin 16. A magnet spacer 17 is provided in a gap between the magnet plate 14 and the yoke plate 7. The core piece 12 and the magnet plate 14 are formed of magnetic materials. Therefore, the magnet plate 14, the screw 10, the yoke plate 7, the armature 3 and the core piece 12 are combined to constitute a magnetic path for the permanent magnet 13.

When being charged with no electricity, the armatures 3 are attracted by one end surface 12*a*, resisting the elastic forces of the driving arms 4*a* which are in turn, as illustrated in FIG. 1, brought into a biased state. When charging the coil 15 with the electricity, the magnetic fluxes, which are given by the permanent magnet and which pass through the magnetic path, are offset, thereby releasing the armatures 3 from the magnetic attraction to one end surface 12*a* of the core piece. The driving arms 4*a* therefore advance by their elastic forces to move the printing wires 1 forward, and dots are formed on an unillustrated printing medium. When no electric current runs through the coil 15, the armatures 3 are attracted again to one end surface 12*a* of the core piece and revert to their initial states.

These operations will now be described in greater detail. The armatures 3 are released from the magnetic attraction and advance forwardly by the elastic forces of the driving arms 4*a*. The driving arms 4*a* are hindered from advancing by the stopper 8 via the spacer 9 almost at the instant when the printing wires 1 impinge on the platen, thus stopping the movements of the armatures 3. In a prior art printing head, a part of the stopper or of an auxiliary resilient plate which is contiguous to the base portion of the resilient plate is flush with a part of the stopper or of the auxiliary resilient plate which is contiguous to the flexural portion of the resilient plate, and hence a gap is still formed between the resilient plate and the stopper or the auxiliary resilient plate even when the printing wires advance enough to collide with the platen. The resilient plate is therefore able to make a further advance, and it follows that the S-shaped extra flexure described hereinbefore results due to the reaction of the platen. On the other hand, in the present invention, the stopper 8 is interposed between the driving arms 4*a* and the stopper plate 5, and a rearward protrusion equivalent to the thickness thereof is provided, thereby hindering further advance of the driving arms 4*a*. Consequently, the extra flexure incidental to the prior art arrangements is not produced. Namely, the driving arms 4*a* are not bent in the S-shape, with the result that when no electric current flows through the coil 15, the armatures 3 again undergo magnetic attraction, at which time the armatures are thereby allowed to initiate immediate return without causing minute vibrations. Even after finishing the return, no minute vibration of the driving arms 4*a* takes place, and the immediate action can be taken on the basis of the next signal.

Figure 7:
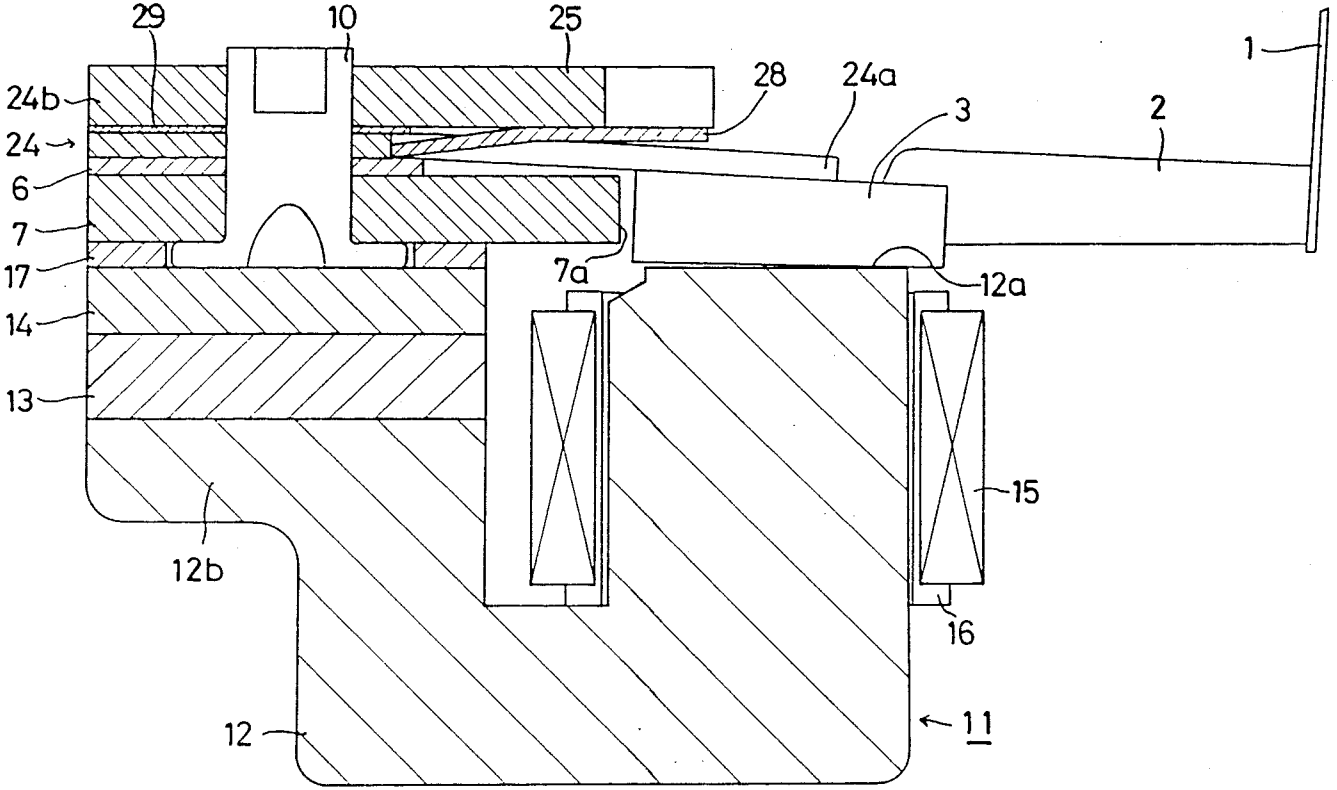
Figure 8:
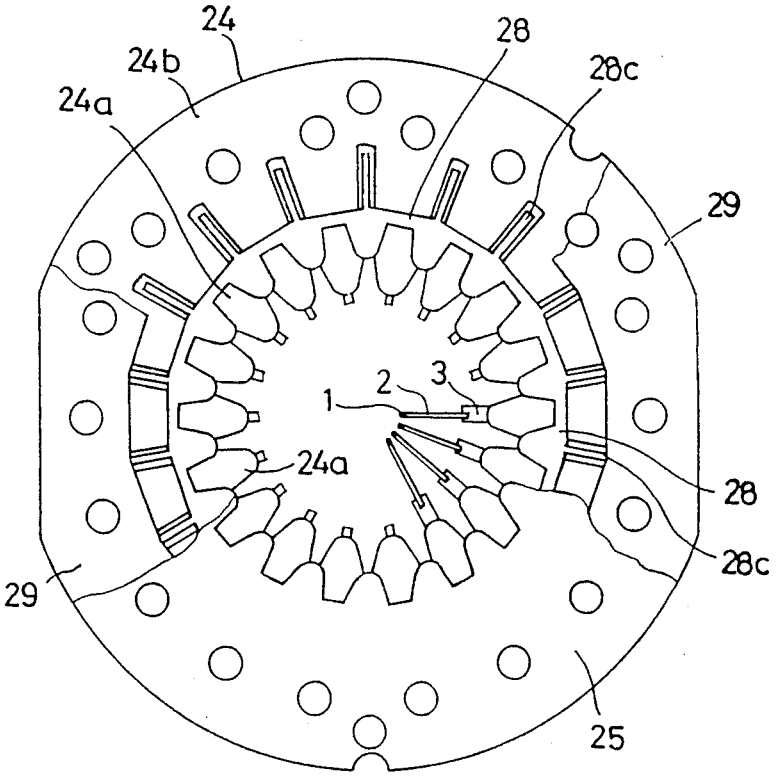
Figure 9:
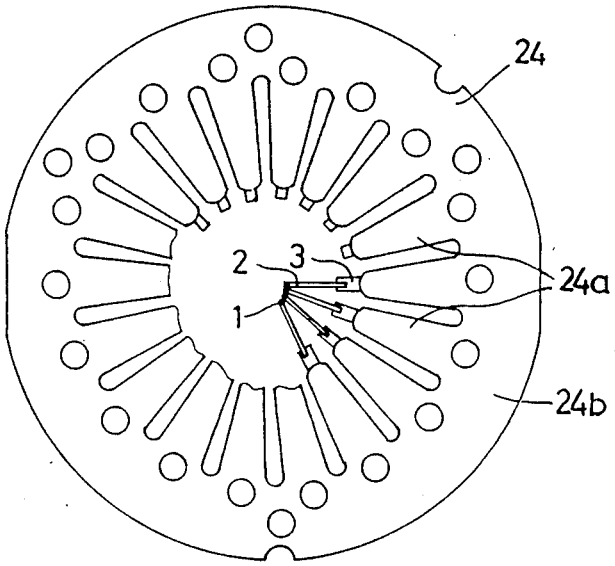
Figure 10:
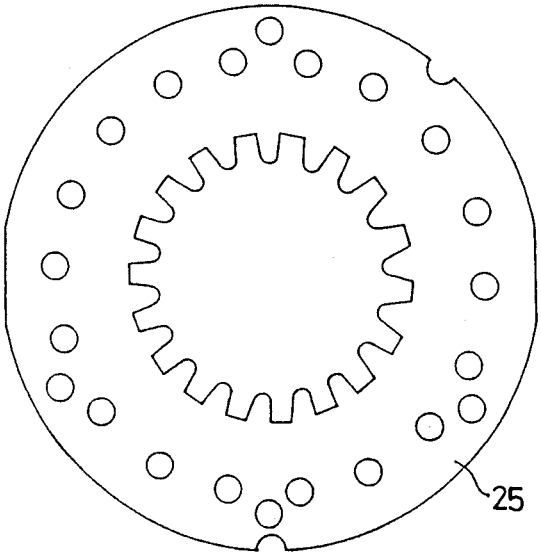

Referring to FIGS. 7 to 12, there is shown another embodiment of the present invention. Apropos of the driving arm assembly, a resilient plate 24 mounted with driving arms 24*a* is constructed virtually in the same manner as that of the preceding embodiment except that, as illustrated in FIG. 9, 18 pieces of driving arms are provided, and a stopper plate 25 is constructed virtually in the same manner as that of the preceding embodiment except the above and that, as shown in FIG. 10, no engaging hole is provided. Interposed between a base portion 24*b* of the resilient plate 24 and the stopper plate 25 is a ring-like thin tabular spacer 29 of which a stopper 28 is located inwardly to face the driving arm 24*a*. The stopper 28 is, as shown in FIG. 7, formed thicker than the spacer 29. On an outer periphery of the stopper 28, a plurality of leg portions 28*c* are, as shown in FIGS. 11(A) and 11(B), extended radially and bent to intrude in gaps between the driving arms 24*a*, thus regulating relative rotations thereof. Tips of the leg portions 28*c* are overlapped with an inner peripheral part of the spacer 29 to prevent the stopper 28 from coming off. In other configurations, virtually the same components as those in the first embodiment are marked with like numerals. The operation in the second embodiment is the same as in the first embodiment.

In the printing head of the invention having the foregoing arrangement, as discussed above, the stopper is located between the driving arms and the stopper plate. This arrangement serves to hinder the advances of the driving arms almost simultaneously when the dots are formed by the printing elements, whereby the extra flexures of the driving arms are prevented. In addition, minute vibrations are restrained, and for this reason the returning time is reduced. Double printing and print skipping can be minimized in frequency, thereby attaining high-speed printing. Since extra flexures can be prevented, it is possible to improve the durability. The stopper and the spacer are composed of the thin tabular members, and the manufacturing processes are thereby simplified. It is also feasible to adjust the advance and stop positions of the driving arms with facility by superposing, if necessary, a desired number of stoppers. This is in turn effective in simplifying the assembly and reducing the costs.

Although the illustrative embodiments of the present invention have been described in detail with reference to the accompanying drawings, it is to be understood that the present invention is not limited to those precise embodiments. Various changes or modifications may be effected therein by one skilled in the art without departing from the scope or spirit of the invention.

What we claim is:

1. A printing head comprising:

a ring-like resilient plate having an outer base portion and a plurality of centripetally disposed resilient driving arms having printing elements operable to strike against a platen;

electromagnetic means comprising a permanent magnet and a coil for effecting actuation of said driving arms for movement between an advanced print position and a non-advanced position and in which said driving arms are held in said non-advanced position by said permanent magnet and are resiliently moved to said advanced print position upon operation of said coil which effects release of said driving arms from said permanent magnet;

a stopper plate means secured with said outer base portion of said resilient plate and having a radial inner portion juxtaposed to said driving arms on the advancing side of said driving arms; and a ring-like stopper element in the form of a thin tabular member disposed between said radial inner portion of said stopper plate means and said driving arms for engaging and stopping the advancing movement of said driving arms substantially at the time that said printing wires strike said platen.

2. A printing head according to claim 1 wherein said stopper plate means comprises a stopper plate member and a ring-like spacer, said ring-like spacer being disposed between said stopper plate member and said resilient plate.

3. A printing head according to claim 2 wherein said ring-like spacer has an outer radial portion and an inner radial portion, said outer radial portion being disposed between said stopper plate member and said base portion of said resilient plate, said inner radial portion of said spacer being disposed between said stopper element and said driving arm of said resilient plate.

4. A printing head according to claim 3 wherein said stopper plate member has a plurality of engaging holes, said stopper element having a plurality of projections received in said engaging holes for retaining said stopper element in its position between said stopper plate member and said driving arms.

5. A printing head according to claim 4 wherein said spacer has a plurality of openings underlying said engaging holes in said stopper plate member.

6. A printing head according to claim 1 wherein said stopper plate means comprises a stopper plate member and a ring-like spacer, said spacer being disposed between said base portion of said resilient plate and said stopper plate member, said stopper element being disposed radially inwardly of said spacer between said stopper plate member and said resilient driving arms, said stopper element being thicker than said spacer.

7. A printing head according to claim 6 wherein said driving arms are spaced from each other, said stopper element having a plurality of radially extending portions extending into the spaces between said driving arms to retain said stopper element in position.

8. A printing head according to claim 1 wherein said stopper element has spaced projections projecting radially inwardly, the spaces between said projections overlying said driving arms.

9. A printing head according to claim 1 wherein said stopper plate means comprises a stopper plate member and a ring-like spacer, said spacer being disposed between said stopper plate member and said resilient plate, said stopper plate member having an outer radial portion and an inner radial portion, said outer radial portion of said stopper plate member overlying said base portion of said resilient plate, said inner radial portion of said stopper plate member overlying said resilient arms, and connecting means connecting together said outer radial portion of said stopper plate member, said spacer, and said base portion of said resilient plate.

10. A printing head according to claim g wherein said spacer has an outer radial portion and an inner radial portion, said connecting means connecting together said outer radial portion of said stopper plate member, said outer radial portion of said spacer, and said base portion of said resilient plate, said inner radial portion of said spacer being disposed between said driving arms and said stopper element.

11. A printing head according to claim g wherein said stopper element is disposed radially inwardly of said spacer between said inner radial portion of said stopper plate member and said resilient arms, said stopper element being thicker than said spacer element.

12. A printing head according to claim 11 wherein said driving arms are spaced from one another, said stopper element having spaced arms extending radially outwardly, said arms being disposed in the spaces between said driving arms to thereby retain said stopper element in its position.

13. A printing head according to claim 12 wherein said stopper element has spaced projections projecting radially inwardly, the spaces between said projections overlying said driving arms.

* * * * *